United States Patent [19]

Sullivan et al.

[11] 4,158,853

[45] Jun. 19, 1979

[54] MONITORING SYSTEM FOR MEASURING KINEMATIC DATA OF GOLF BALLS

[75] Inventors: Paul F. Sullivan; Randall W. Moore, both of Acushnet; Hoyt C. Hottel, Jr., Mattapoisett; Raymond G. Pelletier, New Bedford; William Gobush, North Dartmouth; Francis deS. Lynch, Mattapoisett, all of Mass.

[73] Assignee: Acushnet Company, New Bedford, Mass.

[21] Appl. No.: 832,563

[22] Filed: Sep. 12, 1977

[51] Int. Cl.[2] ..... H04N 7/18

[52] U.S. Cl. ..... 358/93; 358/107

[58] Field of Search ..... 273/183 C, 186 R, 186 RA, 273/186 C, 235 A, 185 R; 356/23, 27; 358/83, 93, 101, 105, 107, 108, 125; 73/167; 354/131, 132, 76; 35/29 A

[56] References Cited

U.S. PATENT DOCUMENTS

| | | | |
|---|---|---|---|
| 2,473,893 | 6/1949 | Lyle | 358/107 |
| 2,825,569 | 3/1958 | Alvarez | 356/23 |
| 3,016,812 | 1/1962 | Chatlain | 358/108 |
| 3,408,750 | 11/1968 | McCollough et al. | 35/29 A |
| 3,630,601 | 12/1971 | Lehoval | 273/183 C |
| 3,793,481 | 2/1974 | Ripley et al. | 358/107 |
| 4,025,718 | 5/1977 | Paretti | 358/105 |
| 4,063,259 | 12/1977 | Lynch et al. | 35/29 A |

FOREIGN PATENT DOCUMENTS

| | | | |
|---|---|---|---|
| 946863 | 5/1974 | Canada | 273/185 R |

OTHER PUBLICATIONS

Casey et al.—Video Sampling and Storage—IBM Tech. Discl. Bull., vol. 11, #2, Jul. 1968, pp. 166–167, 358–393.

*Primary Examiner*—Robert L. Griffin
*Assistant Examiner*—Joseph A. Orsino, Jr.
*Attorney, Agent, or Firm*—Eyre, Mann, Lucas & Just

[57] ABSTRACT

A video data acquisition system takes at least two snapshot views of selected points on a golf ball in the immediate post-launch time period. Analog video data are converted to digital data for analysis in an external system.

A trigger generator, of a type well known in the art, senses the existence of a certain set of conditions associated with the launch of the golf ball and thereupon generates a set of precisely timed impulses which trigger the following sequence of events:

(a) prepare TV camera to receive data
(b) trigger first flash
(c) trigger second flash
(d) read out data from TV camera.

10 Claims, 4 Drawing Figures

MONITORING SYSTEM FOR MEASURING KINEMATIC DATA OF GOLF BALLS

SUMMARY OF THE INVENTION

The present invention relates to apparatus for monitoring the position, velocity and spin of golf balls or other balls. More specifically the invention is capable of measuring the conditions just after launch of spherical projectiles used in sports, such as golf balls, tennis balls, bowling balls, and baseballs. In addition the system can be used to monitor other moving sports objects besides golf balls such as the club head of a golf club. To simplify the description, the specific and preferred case of monitoring the launch conditions of a golf ball will be described. It will be clear that the devices and methods described for measuring the launch conditions of a golf ball apply to the enumerated and other unenumerated objects.

At least one electro-optical sensor, and preferably two or more, have aiming and fields of view appropriate to encompass the initial portion of the flight of the golf ball.

Numerous types of electro-optical sensors can be used to detect a bright object within their fields of view and provide signals which allow measusrement of the X and Y position of an object. For example, a large area silicon photodiode detector can provide a precise measurement of target position. Most of the TV-type cameras can also be used. A vidicon camera is preferred because of its low cost, ruggedness and simplicity of adjustment although any other electro-optical sensor which can provide an indication of X and Y position of a bright spot may be used.

The golf ball is equipped with a plurality of spots, preferably of retroreflective material, each spot covering less than half of the projected area of the ball. The number and placement of the spots of retroflective material is chosen so that at least one spot is available to each camera. A round spot having a diameter of from about 1/32 of an inch to about 1 inch is adequate to obtain measurements but a spot having a diameter of from about ⅛ inch to about ¼ inch is preferred and excellent results have been obtained with spots having a diameter of about 5/32 inch. Retroreflective spots in longitudinal shapes are equally to be understood to be encompassed by the invention. In addition, a ball fully covered with retroreflective material except for the omission of at least one spot having the characteristic described are likewise included.

The retroreflective material contemplated for use on the ball is of the type sold by the 3M Company under the trademark "Scotchlite" . Scotchlite material consists of spherical beads of transparent material adhesively attached to a substrate of flexible material. In some grades of Scotchlite material the beads are exposed, whereas in other grades the beads are covered by a transparent sheet.

A retroreflective material returns incident light very preferentially back toward the source of the light. The contemplated Scotchlite material is available in grades which appear as much as 900 times brighter than a perfect Lambertian reflector as seen from the source of illumination. A brightness increase of at least 2 as compared to a Lambertian reflector is required. The apparent brightness of the retroreflective material decays rapidly as the viewing line of sight diverges from the illuminating line of sight, called the divergence angle, losing a factor of 10 in some examples for only a 1 degree divergence angle between the sight lines. The limit of usefulness of retroreflective material is at a divergence angle of 10 degrees. In addition, the apparent brightness decays with the angle of illumination/sight off the normal to the retroreflective material, called the incidence angle. The decay is more gradual with increases in incidence angle than with increases in divergence angle. With suitable geometry, the apparent brightness of the retroreflective material is so great that the sensitivity of the electro-optical sensor can be reduced to the point that background interference from non-retroreflective objects is substantially suppressed or eliminated entirely.

Other types of retroreflective material are well known in the art and may be substituted for the trademarked Scotchlite material herein described without departing from the scope of the invention. For example, corner-reflector type retroreflectors of various materials may advantageously be used. Corner reflector retroreflectors can be obtained commercially which have apparent brightness at least as great as Scotchlite materials.

It is to be understood that adequate signal to noise ratio may be obtainable without the use of retroreflective material on the ball. For example, a system using contrasting colored paint spots on the ball is within the contemplation of the present invention.

At least one flash lamp, of a type capable of producing brief high-intensity pulses of light, is associated with each camera. The illumination from the flash lamp is directed as closely as possible along the axis of the field of view of its associated camera in order to minimize the retroreflective divergence angle. The illumination from the flash lamp is preferably directed directly along the axis of the field of view of its associated camera. An optical combiner may be used to reflectively combine the illumination line of sight concident with the center of the camera field of view. To accomplish this combining, it is required to place a diagonal mirror or prism in front of the camera lens and thereby block part of the returning light. The blockage of the camera lens can be avoided by placing the light source adjacent to the camera lens.

The duration of the flash is made short enough to freeze the motion of the projectile in flight. It is well known that gas-type flash lamps can produce a single light output pulse of greater intensity than can the same flash lamp when programmed to produce two or more closely spaced light output pulses. In order to place enough light on the golf ball to get a noise-free picture in the required short time interval, the single flash lamp providing two flashes per launch may alternately be replaced by two flash lamps flashed in sequence.

A trigger signal from a trigger generator triggers the one or two flash lamps into producing two precisely timed flashes just following the launch of the ball. The trigger generator also resets the TV camera sweep and delays the initiation of a new sweep until after the completion of the second flash.

A spot X/Y position decoder operates on the first scan of the TV camera to determine the X and Y position of the TV camera scanning beam at which the two bright spots have impinged. The decoded X and Y positions are made available to external computing circuits.

DETAILED DESCRIPTION OF THE PREFERRED EMBODIMENT

Figure 1:
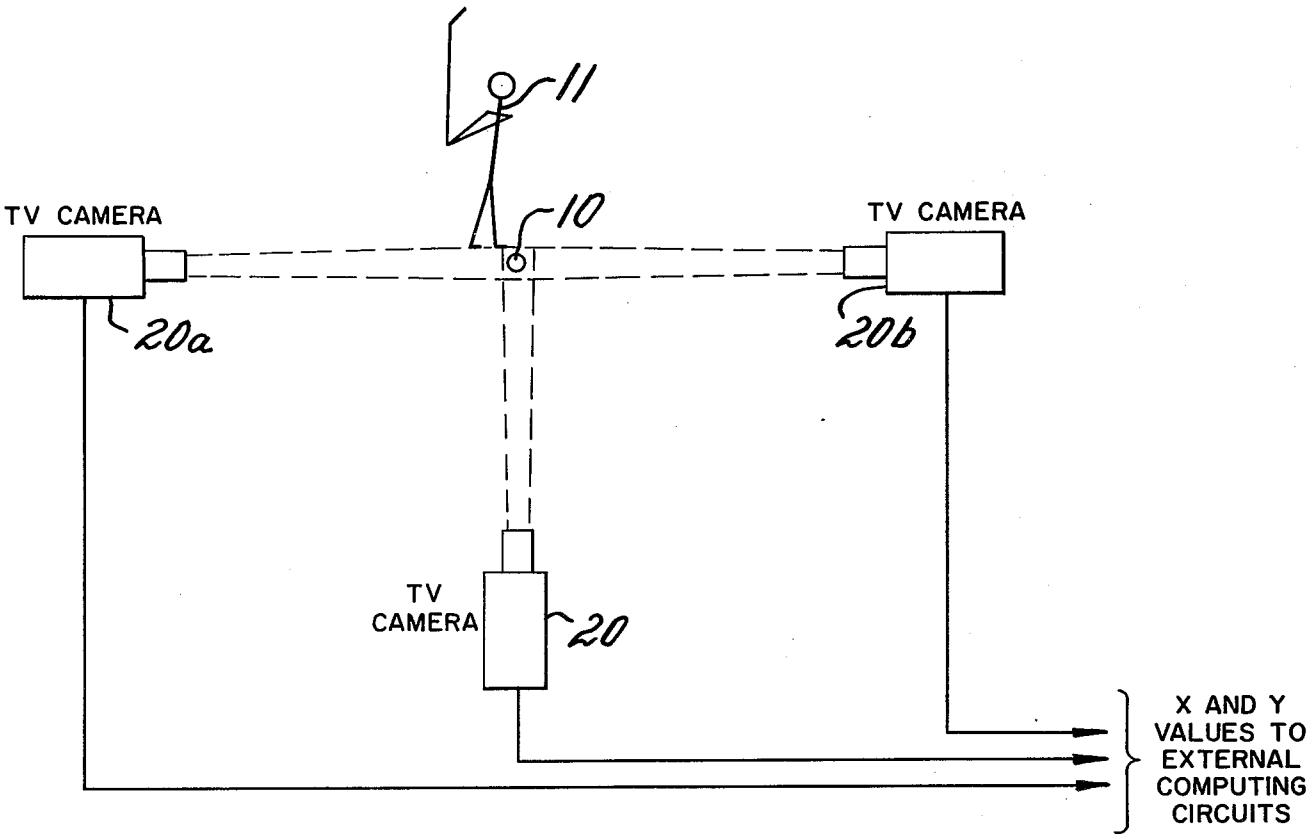
FIG. 1 shows an overall view of a measurement setup embodying the principles of the present invention.

Referring to FIG. 1, the general measurement arrangement is shown. A golf ball 10 rests alongside a golfer 11. TV cameras 20, 20*a* and 20*b* each having small fields of view are aimed at the vicinity of the golf ball 10. After launch of the golf ball 10, two snaphot pictures at closely spaced time intervals are simultaneously taken by all three cameras 20, 20*a*, 20*b*. It will be understood that only one snapshot is necessary if the original orientation of the ball on the tee is known. In order to be able to make measurements, the brightness of a small portion of the surface of the golf ball 10 visible to each camera 20, 20*a*, 20*b* is enhanced. After the second snapshot, digital numbers representing the apparent X and Y positions of the enhanced spot at the two snapshot positions are read out to external computing circuits. Using the known ball 10 dimensions, the known time between snapshots, and the known geometric relationships between the TV cameras, the external computing circuits are able to calculate the X, Y and Z positions of each enhanced spot in a common coordinate system at the time of each snapshot. From the position information and the known data the external computing circuits are able to calculate the ball velocity and spin in three dimensions during the immediate post-launch time period. Given the initial velocity and spin, plus known aerodynamic characteristics of the ball 10, the external computing circuits are capable of accurately predicting the flight path and point of landing of the ball.

Although a three-camera measurement system is shown, other numbers of cameras may be used. For example, most of the data can be taken using a single TV camera, for example, camera 20 and a plurality of enhanced spots on the ball. Although the ability to measure displacement and spin of the ball 10 out of the plane of observation is limited in a one-camera system, the accuracy can be made satisfactory for some applications. A two-camera system, for example 20 and 20*b* using a plurality of enhanced spots can restore accuracy to close to that achieved with a three-camera system. Since at least some of the positioning accuracy is attained through triangulation, best accuracy is obtained when the angle between the lines of sight of the two cameras 20, 20*b* is near 90 degrees, but satisfactory accuracies are attainable at line of sight crossing angles of 30 degrees.

A four-camera system may be needed to perform the functions shown in FIG. 1 if both left-handed as well as right-handed golfers 11 are to be accommodated. This need arises due to the possibility that some part of the body of the golfer may obscure the desired line of sight from one of the cameras, for example 20. In that case, an alternative camera, having an unobscured line of sight may be substituted.

Figure 2:
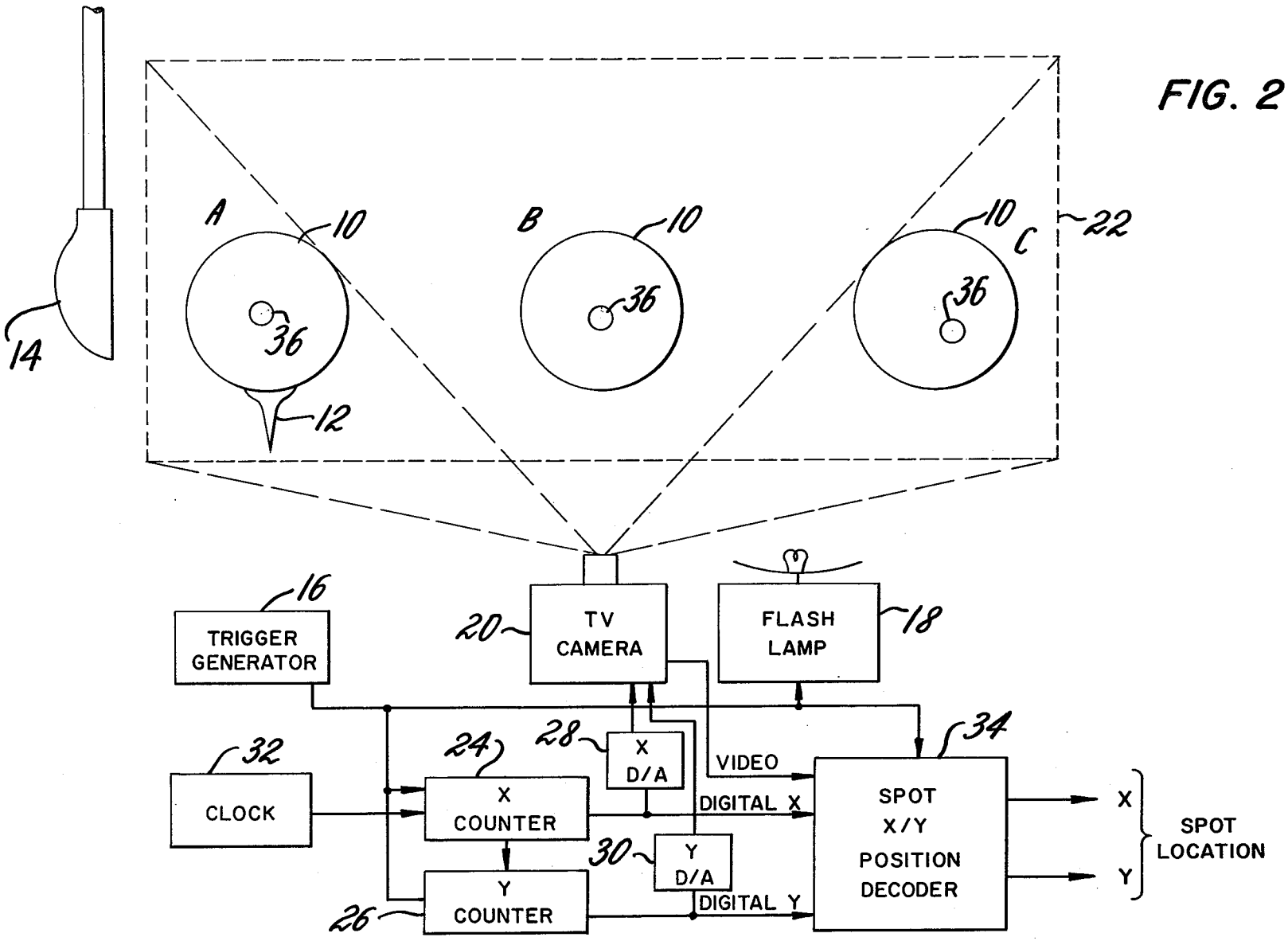
FIG. 2 shows a block diagram view of one of the measuring cameras and its associated devices.

FIG. 2 shows the apparatus associated with one of the TV cameras 20 described in the preceding. The golf ball 10 is shown resting at position A on a tee 12 immediately before being struck by a golf club head 14. A trigger generator 16 senses that impact between the club head 14 and the ball 10 is about to occur, is occuring, or has just occurred. The sensor for the trigger generator 16 may be for example a light beam and photocell triggered by passage of the club head 14, a magnetic, electrostatic, or dielectric sensor detecting the passage of the club head 14, a switch actuated by a fine thread broken by passage of the club head 14, a fluidic sensor in the tee 12 which reacts to change in pressure of an axial column of air in the tee shaft when the ball leaves the tee 12, an electro-optical sensor in the vicinity of the ball 10, or an acoustic sensor which is actuated by the click of the club head 14 against the ball 10.

The trigger generator 16 provides a trigger signal to a flash lamp 18 which flashes to illuminate the ball 10 at its new post-impact position at B. The time from impact to position B should be sufficient to allow any flattening or distortion of the ball 10 to be relieved, but should end as quickly as possible thereafter. High-speed photography has disclosed that ball distortion ends within about 0.4 milliseconds after impact for most types of modern golf balls.

The TV camera 20 is positioned with its field of view 22 encompassing all possible positions B, C of the ball 10 within a certain time period after launch. The linear dimensions of the camera field of view 22 are determined by the maximum probably post-launch speed and the time between launch and the second snapshot at position C. As the size of the field of view 22 is made larger, with correspondingly longer delay between impact and the second snapshot at position C, a longer measurement baseline is available. However, the accuracy otherwise available from the longer baseline is cancelled by a corresponding reduction in resolution due to the growth of the resolution cell size in the target plane. In addition, the light intensity from the flash lamp decreases in proportion to the inverse square of the linear dimension of the field of view. The decrease in light intensity requires either higher flashlamp power or the acceptance of a degraded signal-to-noise ratio. The time between the first and second flashes can be between 0.25 and 2 milliseconds but for best results a time between flashes of 0.5 milliseconds is long enough to give a reasonable distance between position B and C without opening up the required field of view to the point that the illumination power required gets unmanageable.

The duration of the flash should be short enough to give good resolution of the ball 10 in order to achieve measurement accuracy. Because of the speed with which the ball 10 is travelling, the duration of the flash is suitably no more than one ten-thousandth of a second and preferably no more than a few millionths of a second.

The TV camera 20 can be of any type now known or to become known in the art including but not limited to vidicons of all types, image orthicons, and solid state TV cameras. In addition, the TV camera may be replaced by a four-output optoelectronic sensor (e.g. a Posicon sensor from United Detector Technology) or by a tracking sensor without departing from the spirit of the invention.

An intermediate optical storage device (not shown) may be included in the TV camera 20 for temporary storage of one or more images. For example, a pockels cell, well known in the art, may be employed to temporarily store the X and Y positions of the spot being viewed. After storage, the spot X and Y position may be read out using the TV camera 20 as previously described. After reading out the spot X and Y position, the stored spot position may be electrically erased from the pockels cell. For purposes of illustration the TV camera 20 is assumed to be a vidicon.

Sweep voltages for the X and Y scans of the TV camera are generated by a digital X counter and a digital Y counter and converted to analog sweep voltages in an X digital-to-analog converter 28 and a Y digital-to-analog converter 30, respectively. The X counter 24 is driven by a free-running clock 32. The X digital-to-analog converter 28, for instance generates an analog voltage for connection to the X deflection device in the TV camera 20, whose amplitude is proportional to the digital number connected to its input by the X counter 24. The analog X sweep voltage connected to the TV camera changes in small steps corresponding to the changes in the number in the X counter 24. The scanning beam of the TV camera 20 thus moves in precise incremental steps across the camera photocathode. Each incremental X position of the scanning beam corresponds to the X position of one resolution cell. The digital scan generation method above described is illustrative only and should not be construed as limiting. Other scan generation methods, for example, those employing analog sweep, can be used without departing from the spirit of the present invention.

The digital numbers representing the scanning beam X and Y position are connected to a spot X/Y position decoder 34. The TV camera 20 video output signal is also connected to one input of the spot X/Y position decoder 34. A small retroreflective spot 36 is affixed to the ball 10 in a position where it is visible to the TV camera 20 with an incidence angle of less than 80 degrees at all positions of interest and at least at positions B and C. The positioning of the flash lamp 18 such that its illumination axis is as nearly coincident with the axis of the TV camera 20 field of view 22, makes the retroreflective spot 36 effective to enhance the apparent brightness of the spot by a factor of from about 2 to 1 to about 900 to 1 or even higher with a preferred brightness enhancement of at least about 500 to 1. The brightness enhancement is greatest when the flash lamp 18 illumination axis is optically coincident with the axis of the TV camera 20 field of view 22.

The passive retroreflective spot 36 may be replaced by an active light source, such as a light emitting diode, on the ball 10. If an active light source is used, the flash lamp 18 is not required.

Most types of TV cameras 20 contain a light-sensitive surface, called a photocathode, upon which an image of the scene is focussed. In their normal functioning, each spot on the photocathode is allowed to build up a charge from the scene for an inter-scan period, typically one thirtieth of a second and then is discharged by the passage of the scanning beam. In effect, the photocathode integrates the scene elements imaged upon it for the entire inter-scan period. It is thus desirable to scan the TV camera 20 photocathode in the time preceding the operation of the trigger generator 16 in order to keep the photocathode erased.

Upon detection of the launch of the ball 10 by the trigger generator 16, a signal connected from the trigger generator 16 in parallel to the X counter 24 and the Y counter 26 resets and holds these counters in the reset condition for at least as long as it takes for the ball 10 to pass through positions B and C. The TV camera 20 photocathode thereupon has stored upon it the two images of the retroreflective spot 36 fixed upon it during the short light flashes of flash lamp 18 when the ball was at positions B and C. All other scene elements, not having retroreflective enhancement, are substantially suppressed.

After the second flash, a trigger signal from the trigger generator 16 enables the X counter 24 and Y counter 26 to resume the generation of the scanning signals. The trigger generator 16 also enables the spot X/Y position decoder 34 to accept the digital X and Y numbers and the TV video for the first full scene of the renewed scan of TV camera 20 photocathode. As the scanning beam is swept over the portion of the TV camera 20 photocathode which contains the image of the retroreflective spot 36 at one of its positions, the abrupt change in the video signal connected to the spot X/Y position decoder 34 causes the spot X/Y position decoder 34 to accept and temporarily store the digital X and Y numbers at which the image of the retroreflective spot 36 was sensed. At the completion of the scanning of the photocathode, the spot X/Y decoder 34 contains two pairs of X-Y numbers representing the measured X and Y positions of the retroreflective spot at positions A and B.

Figure 3:
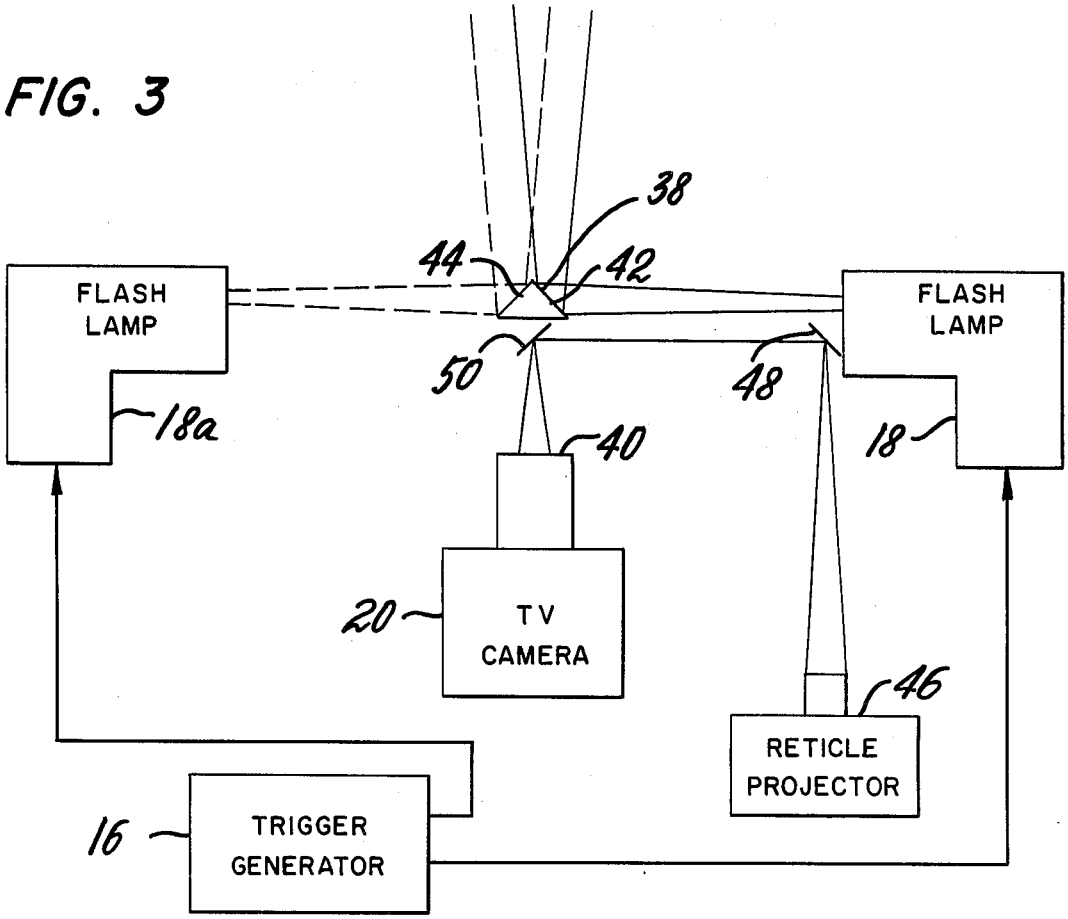
FIG. 3 shows an apparatus for directing light onto the ball coincident with the center of the camera field of view.

FIG. 3 shows a method for optically directing the axis of the flash lamp 18 illumination coincident with the center of the TV camera 20 field of view. A diagonal mirror or prism 38 is located in front of the lens 40 of the TV camera 20. The output light of the flashlamp 18 is directed onto a diagonal surface 42 of the diagonal mirror or prism 38. The output light is directed outward in the same direction as the TV line of sight with the illumination axis and center of the line of sight being substantially collinear. If the blockage of the lens 40 by the diagonal mirror or prism 38 is small compared to the size of the lens 40, there is only a minor reduction in the light entering the TV camera. The divergence of the light from the flashlamp 18 is such that the illuminated area in the target plane is substantially equal to the field of view of the TV camera.

A second flashlamp **18*a* may be used for the second flash in order to get sufficient light output in two flashes. The second flashlamp 18*a* may be placed adjacent to the TV camera 20 similar to the camera position shown in FIG. 2 with its illumination axis parallel to the TV camera 20 line of sight. Best results are achieved by optically directing the axis of the second flashlamp coincident with the center of the TV camera field of view. This may be accomplished as shown in FIG. 3 using a second diagonal surface 44 on the diagonal mirror or prism 38 and directing the optical output of the second flashlamp 18*a*** upon it.

Fixed calibration or reference images may be optically inserted into the TV camera 20 using a reticle projector 46 and two diagonal mirrors 48 and 50. The calibration or reference images may contain one or more bright spots in predetermined locations which, when processed by the spot X/Y position decoder 34, provide calibration outputs to external circuits. For example, if there are variations internally in the optical equipment such as line voltage variations which shift the X and Y values at which a fixed calibration spot is detected, the calibration X and Y value can be used by external circuits to develop a scaling signal to correct measured values of the retroreflective spot position.

The mirror 48 can be eliminated if the output of the reticle projector 46 can impinge directly upon diagonal mirror 50. This is readily accomplished by, for example, repositioning the reticle projector 46 and rotating the diagonal mirror 50 so that the beam from the reticle projector 46 is directed into or out of the page onto the diagonal mirror 50.

Figure 4:
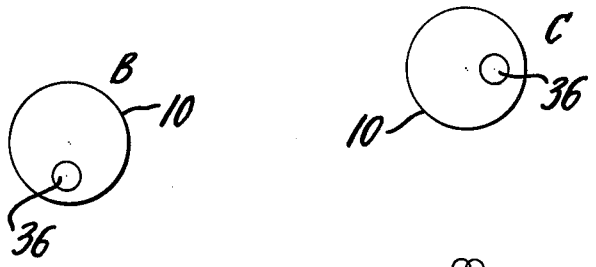
FIG. 4 shows a block diagram of an alternative embodiment of a measuring instrument and associated devices.
Figure 4:
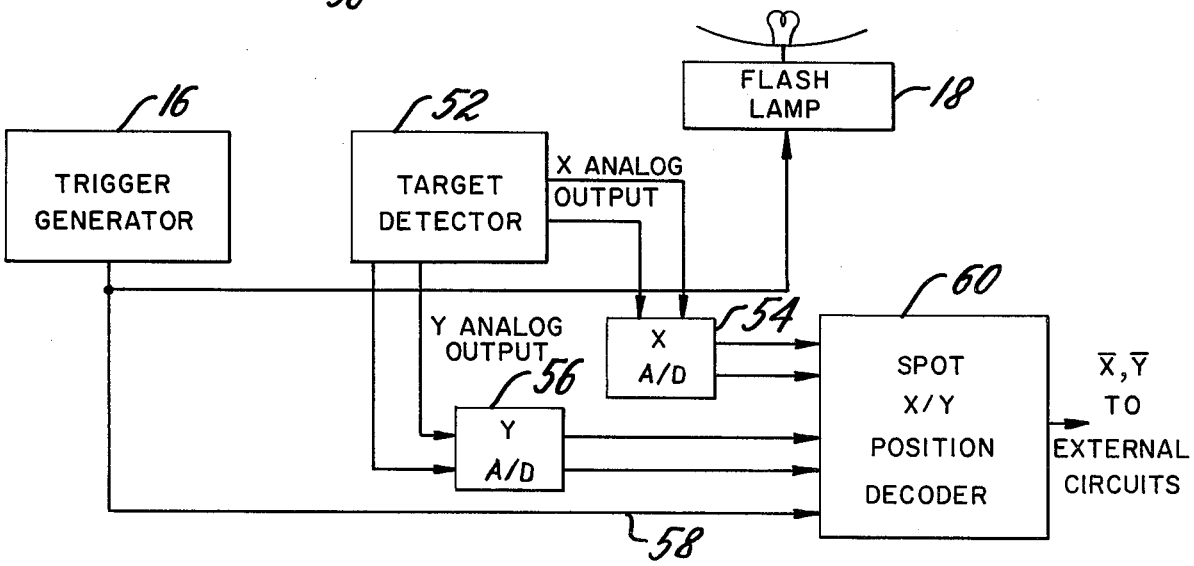

Referring now to the alternate embodiment in FIG. 4, the TV camera 20, clock 32, X counter 24, and Y counter 26 of FIG. 2 have been replaced with a target detector 52. One type of target detector 52 which may be used is a large area four-electrode silicon photodiode detector of the type available from United Detector Technology under the Trademark "Posicon". This type of photodetector generates one pair of analog outputs whose amplitude relationships indicate the position of a bright spot in the horizontal direction and a second pair of outputs whose amplitude relationships indicate the position of the bright spot in the vertical direction.

An X analog to digital converter 54 and a Y analog to digital converter 56 each receive the two analog position signal from the associated pairs of electrodes in the target detector 52.

An enable signal 58 is connected from the trigger generator 16 to a spot X/Y position decoder 60 only when the flash lamp 18 is triggered into operation. When enabled, the spot X/Y position decoder 60 stores the instantaneous digital values which indicate the position of the spot. The X/Y position decoder 60 may perform the computations which determine the centroidal values of $\overline{X}$ and $\overline{Y}$ or it may merely temporarily store the four digital numbers from which the centroidal values may be calculated by external circuits.

It will be understood that the claims are intended to cover all changes and modifications of the preferred embodiments of the invention, herein chosen for the purpose of illustration which do not constitute departures from the spirit and scope of the invention.

What is claimed is:

1. A system for monitoring a moving sports object comprising:

(a) at least one electro optical sensor;

(b) at least one passive spot of retroreflective material affixed to said sports object covering substantially less than half the projected area of said sports object;

(c) a first light source having its illumination axis no more than 10 degrees from the line of sight of said electro optical sensor to said retroreflective material;

(d) a second light source having its illumination axis no more than 10 degrees from the line of sight of said at least one electro optical sensor to said retroreflective material;

(e) said retroreflective material and each of said first and second light sources enhancing the contrast of said at least one passive spot with the surface of said sports object by a factor of at least 2 to 1;

(f) means for triggering each said light source into operation at least once while said at least one spot is moving and within the field of view of said electro optical sensor;

(g) said first light source being triggered into operation by said means for triggering at a first time during the initial flight of said sports object;

(h) said second light source being triggered into operation by said means for triggering at a second time during the initial flight of said sports object, the time between said first and second times being known; and (i) electronic means for generating first and second digital numbers representative of the relative position of said at least one spot along first and second axes respectively within the field of view of said at least one electro optical sensor at each of the times said first and second light sources are triggered into operation.

2. The monitoring system recited in claim 1, wherein said electro optical sensor is a television camera.

3. The projectile monitoring system recited in claim 2, wherein said electronic means comprises:

(a) digital means for defining the horizontal and vertical position of the scanning beam in said television camera;

(b) means for storing said values of horizontal and vertical positions of said scanning beam when said scanning beam crosses an area which has been illuminated.

4. The monitoring system recited in claim 1, wherein said electro optical sensor is a photodiode detector.

5. The projectile monitoring system recited in claim 4, wherein said electronic means comprises:

(a) a first analog to digital converter on a first axis output of said photodiode detector;

(b) a second analog to digital converter on a second axis output of said photodiode detector; and (c) means for storing the digital outputs of said first and second analog to digital converters.

6. The monitoring system recited in claim 1, wherein the field of view of said electro optical sensor encompasses all possible normal flight paths of said golf ball in at least a portion of the first 2.5 milliseconds of flight.

7. A system for monitoring the early flight of a golf ball comprising:

(a) at least one television camera;

(b) the field of view of said at least one television camera encompassing all positions normally occupied by the golf ball in at least a portion of its first 2.5 milliseconds of flight;

(c) at least one spot of retroreflective material affixed to said golf ball;

(d) each spot of said retroreflective material having an area less than 50 percent of the projected area of said golf ball;

(e) at least one flash lamp;

(f) means for triggering at least two separate flash lamp flashes of light within the first 2.5 milliseconds of flight;

(g) the illumination field of view of said at least one flash lamp being at least large enough to encompass the positions occupied by said at least one retroreflective spot affixed to said golf ball during each of said two flashes;

(h) the incidence angle between said television camera line of sight and said flash lamp line of sight to said retroreflective spot being at most small enough at the time of each flash to obtain a brightness enhancement at said at least one television camera of at least two to one as compared to a perfect Lambertian reflector; and (i) electronic means for generating first and second digital numbers representative of the positions of said retroreflective spot along first and second axes respectively in the field of view of said at least one television camera at each of the times of said two flashes.

8. The system recited in claim 7 further comprising:

(a) a second television camera;

(b) the center of the line of sight of said second television camera being at least 30 degrees from the center of the line of sight of said at least one television camera;

(c) a second flash lamp;

(d) said second flash lamp being associated with said second television camera in the same relationship as said at least one television camera and said at least one flash lamp;

(e) at least a second retroreflective spot, said second retroreflective spot being within the field of view of said second television camera;

(f) said second flash lamp being triggered into producing two flashes of light by said means for triggering; and (g) second electronic means for generating third and fourth digital numbers representative of the positions of at least one retroreflective spot along third and fourth axes respectively in the field of view of said second television camera at each of the times of said two flashes by said second flash lamp.

9. The system recited in claim 8, further comprising:

(a) a third television camera;

(b) the center of the line of sight of said third television camera being at least 30 degrees from the center of the lines of sight of both of said at least one television camera and said second television camera;

(c) a third flash lamp;

(d) said third flash lamp being associated with said third television camera in the same relationship as said at least one television camera and said at least one flash lamp;

(e) at least a third retroreflective spot, said third retroreflective spot being within the field of view of said third television camera;

(f) said third flash lamp being triggered into producing two flashes of light by said means for triggering; and (g) third electronic means for generating fifth and sixth digital numbers representative of the positions of at least one said retroreflective spot along fifth and sixth axes respectively in the field of view of said third television camera at each of the times of said two flashes by said third flash lamp.

10. The system recited in claim 9 further comprising:

(a) a fourth television camera;

(b) the center of the line of sight of said fourth television camera being at least 30 degrees from the centers of the lines of sight of said at least one, second and third television cameras;

(c) a fourth flash lamp;

(d) a fourth electronic means for generating seventh and eighth digital numbers representative of the positions of at least one said retroreflective spot along seventh and eighth axes respectively in the field of view of said fourth television camera at each of the times of said two flashes by said fourth flash lamp.

* * * * *